US008155337B2

(12) United States Patent
Choi et al.

(10) Patent No.: US 8,155,337 B2
(45) Date of Patent: Apr. 10, 2012

(54) COMPATIBLE CIRCUIT AND METHOD FOR 4- AND 5-POLE EARPHONES AND PORTABLE DEVICE USING THE SAME

(75) Inventors: Kyu Won Choi, Suwon-si (KR); Jong Nam Jun, Seoul (KR); Nam Hyung Kim, Suwon-si (KR); Mi Jin Kim, Incheon Metropolitan (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 680 days.

(21) Appl. No.: 12/277,160

(22) Filed: Nov. 24, 2008

(65) Prior Publication Data

US 2009/0136058 A1 May 28, 2009

(30) Foreign Application Priority Data

Nov. 28, 2007 (KR) ..... 10-2007-0122244

(51) Int. Cl.
*H04R 1/10* (2006.01)

(52) U.S. Cl. ..... 381/74; 381/384

(58) Field of Classification Search ..... 381/74, 381/384; 340/533, 538.17; 710/15, 16, 104
See application file for complete search history.

(56) References Cited

U.S. PATENT DOCUMENTS

| | | | | |
|---|---|---|---|---|
| 6,069,960 | A * | 5/2000 | Mizukami et al. | 381/74 |
| 6,988,905 | B2 * | 1/2006 | Corey et al. | 381/74 |
| 7,836,216 | B2 * | 11/2010 | Kashi et al. | 710/15 |
| 2007/0177741 | A1 * | 8/2007 | Williamson | 381/71.6 |
| 2008/0032753 | A1 * | 2/2008 | Nho | 455/569.1 |
| 2008/0164994 | A1 * | 7/2008 | Johnson et al. | 340/533 |
| 2008/0175402 | A1 * | 7/2008 | Abe et al. | 381/71.6 |

* cited by examiner

*Primary Examiner* — Kevin M Picardat
(74) *Attorney, Agent, or Firm* — Jefferson IP Law, LLP

(57) ABSTRACT

A compatible circuit and method for 4- and 5-pole earphones and a portable device are disclosed. The compatible circuit and method alter the path of audio signals, using switches, according to control signals, so that the 4-pole earphone can be used in a portable device designed primarily for a 5-pole earphone. The apparatus and method include determining the type of earphone, altering the audio signal path according to the type of earphone, and transmitting the audio signal to the earphone.

21 Claims, 6 Drawing Sheets

COMPATIBLE CIRCUIT AND METHOD FOR 4- AND 5-POLE EARPHONES AND PORTABLE DEVICE USING THE SAME

PRIORITY

This application claims the benefit under 35 U.S.C §119(a) of a Korean patent application filed in the Korean Intellectual Property Office on Nov. 28, 2007 and assigned Serial No. 2007-0122244, the entire disclosure of which is hereby incorporated by reference.

BACKGROUND OF THE INVENTION

1. Field of the Invention

The present invention relates to earphones and devices using the earphones. More particularly, the present invention relates to a compatible circuit and method for 4- and 5-pole earphones and to a portable device using the same.

2. Description of the Related Art

In recent years, portable devices have been designed to provide a variety of functions in addition to the voice communication function. For example, portable devices now often include a file reproduction function for reproduction of audio and video files, a camera function for photographing a picture or a moving image, a Push To Talk (PTT) function, etc.

The PTT function is a communication service in which, after Internet Protocol (IP) addresses are allocated to respective portable devices, the portable device are able to wirelessly communicate with each other in a one-to-one mode or in a one-to-multi mode using an IP network, without using a mobile communication service network. The PTT function is a means of instantaneous communication commonly employed in radio transceivers in which a push-button is pushed in to select a voice transmission mode and the push-button is released to select a voice reception mode, thereby allowing the devices to be operated in a bi-directional communication mode. This type of radio communication allows a speaker to hear several people simultaneously and allows transmission and reception to be performed through a single frequency band. That is, the PTT service allows a user to communicate with others in a one-to-one mode or in a one-to-multi mode by operating a PTT key. Moreover, the PTT key may be mounted in a portable device or in an earphone coupled to the portable device.

The conventional portable devices that include a PTT function have been employing a 5-pole earphone as the standard. The 5-pole earphone is used, rather than a 4-pole earphone, because it includes an additional pole or terminal for detecting the PTT key. Notably, the 5-pole earphone has an interface unit that has the same physical size as the interface unit of a 4-pole stereo earphone (hereinafter referred to as a 4-pole earphone). Therefore, users may insert a 4-pole earphone plug into a portable device that is designed to use the 5-pole earphone. However, since the pin map is different between the 4- and 5-pole earphones, a portable device designed to employ a 5-pole earphone has difficulty using a 4-pole earphone. More specifically, if a 4-pole earphone plug is inserted into the 5-pole earphone jack of the portable device, a microphone associated with the 4-pole earphone may work normally but the right speaker of the earphone outputs the left audio sound of the stereo and the left speaker outputs a reduced right audio sound. The resulting output may confuse the user into believing that the portable device, designed to be used for a 5-pole earphone, or the 4-pole earphone has malfunctioned.

Once again, these problems are caused because the earphone interface unit of the portable device employing a 5-pole earphone has a different pin map than that of a 4-pole earphone. That is, the pin map differs between the 4- and 5-pole earphones. Therefore, depending on the type of earphone plug connected to the portable device, a circuit is required to adapt to the pin map of the earphone interface unit. To this end, a circuit is needed to detect the type of earphone connected to the portable device and a switching circuit is required to switch the path of an audio signal according to the detected type of earphone.

A circuit is also needed to make a portable device using a 5-pole earphone to recognize the operation of a PTT key.

SUMMARY OF THE INVENTION

An aspect of the present invention is to address at least the above-mentioned problems and/or disadvantages and to provide at least the advantages described below. Accordingly, an aspect of the present invention is to provide a compatible circuit and method that can allow 4- and 5-pole earphones to be used in a portable device, having allowed a 5-pole earphone to be used and employing a Push To Talk (PTT) function. A further aspect of the present invention is to provide a portable device using the compatible circuit and method.

Another aspect of the present invention is to provide a circuit and method for recognizing an operation of a PTT key in a portable device having used a 5-pole earphone. A further aspect of the present invention is to provide a portable device using the circuit and method for recognizing an operation of a PTT key.

In accordance with an aspect of the present invention, a compatible circuit for 4- and 5-pole earphones is provided. The circuit includes an interface unit, to which one of a 4-pole and a 5-pole earphone is connected, a first comparator for detecting if the one of the 4-pole earphone and the 5-pole earphone is connected to the interface unit and for outputting a signal based on the detection result and a switch part for establishing a path of at least one audio signal according to the output signal of the first comparator.

In accordance with another aspect of the present invention, a compatible method for 4- and 5-pole earphones is provided. The method includes detecting, by a first comparator, whether one of a 4-pole and a 5-pole earphone is connected to an interface unit of a portable device, and establishing a path of at least one audio signal according to the detected type of earphone.

In accordance with yet another aspect of the present invention, a portable device is provided. The device includes an interface unit to which one of a 4-pole and a 5-pole earphone is connected, a first comparator for detecting if the one of the 4-pole earphone and the 5-pole earphone connected to the interface unit and for outputting a signal based on the detection result, a switch part for establishing a path of at least one audio signal according to the output signal of the first comparator, an audio processing unit for outputting an audio signals to the one of the 4-pole and the 5-pole earphone through the switch part and the interface unit and a controller for controlling the audio processing unit to generate the audio signals.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description in conjunction with the accompanying drawings, in which.

Throughout the drawings, it should be noted that like reference numbers are used to depict the same or similar elements, features and structures.

DETAILED DESCRIPTION OF EXEMPLARY EMBODIMENTS

Figure 1:
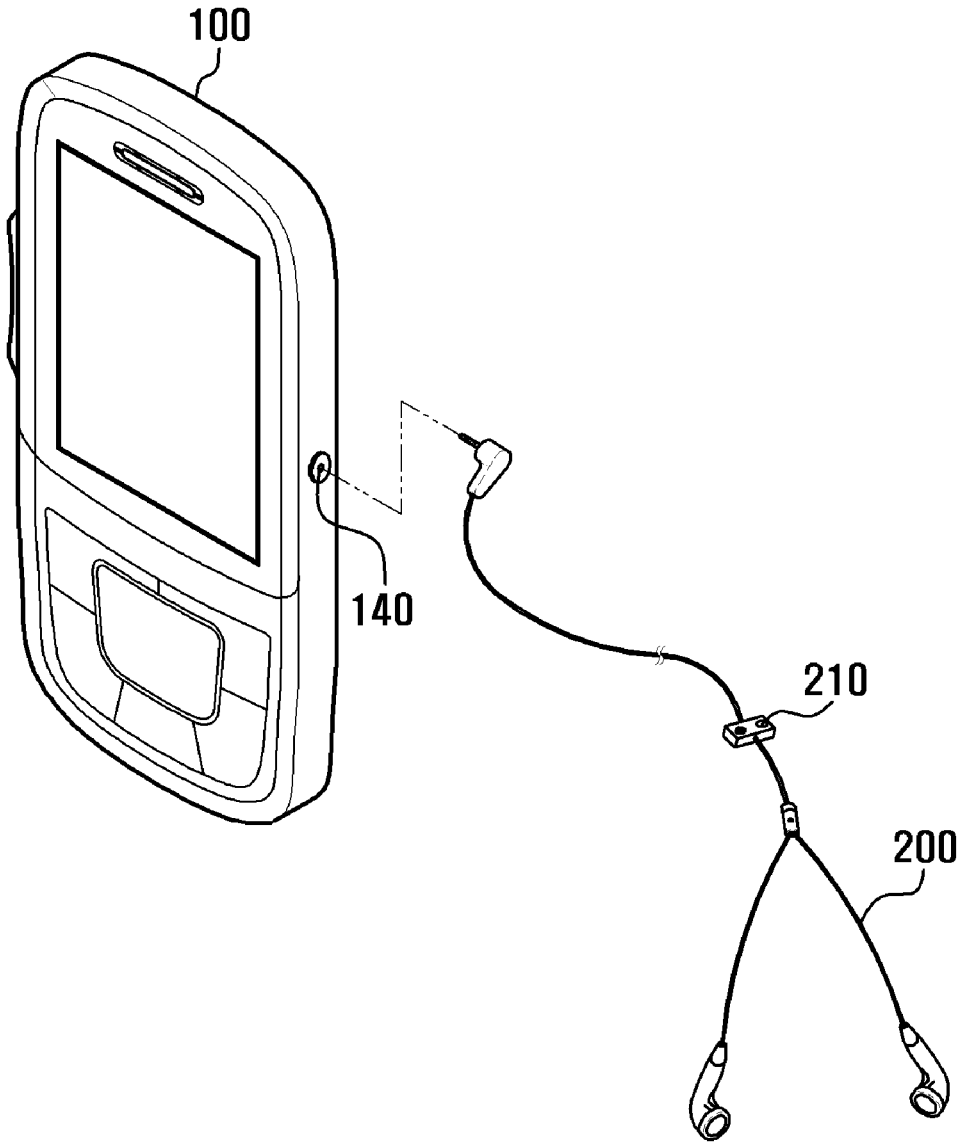
FIG. 1 is a view illustrating a portable device according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms or words described in the present description and the claims should not be limited by a general or lexical meaning, but instead should be analyzed as a meaning and a concept through which the inventor defines and describes the present invention using his best effort, to comply with the idea of the present invention. Therefore, one skilled in the art will understand that the embodiments disclosed in the following description and configurations illustrated in the drawings are merely exemplary, and that there may be various modifications, alterations, and equivalents thereof to replace the embodiments at the time of filing this application.

Although the portable device according to an exemplary embodiment of the present invention is described based on a mobile communication terminal, it will be appreciated that the present invention is not limited by this example. That is, the present invention can be applied to any portable device that employs a PTT function and a 5-pole earphone. It can also be applied to any information communication device, multimedia device, and their applications, such as, a mobile communication terminal with a communication function, a mobile phone, a Personal Digital Assistant (PDA), a smart phone, an International Mobile Telecommunication 2000 (IMT-2000) terminal, a Universal Mobile Telecommunication Service (UMTS) terminal, a digital broadcasting terminal, etc.

FIG. 1 is a view illustrating a portable device according to an exemplary embodiment of the present invention.

Referring to FIG. 1, the portable device 100 may include an earphone 200 that is detachably connected thereto.

The portable device 100 may be classified into various types, for example, a slide type, a folder type, a flip type, etc. This portable device 100 may include an interface unit 140 to which the plug of the earphone 200 is detachably connected. Although only one interface unit 140 is illustrated in FIG. 1, the interface unit 140 may be configured to include an additional number of connecting terminals. Furthermore, the interface unit 140 may be configured to support different types of devices. In particular, the interface unit 140 according to an exemplary embodiment of the present invention allows 4- and 5-pole earphones to be connected thereto. The interface unit 140 may also allow other types of external devices to be connected thereto, such as devices that can support a variety of optional functions, for example, an earphone function, an external speaker function, etc.

The earphone 200 includes a plug for physical connection to the interface unit 140 of the portable device 100, a pair of speakers and a call key 210. The call key 210 may serve as a PTT key for a PTT function and thus will be hereinafter referred to as a PTT key depending on the description.

The earphone 200 is connected to the portable device 100 so that an audio signal can be output from the portable device 100 through the pair of speakers.

The portable device 100 may include a means for detecting whether the earphone 200 is connected thereto and for generating an interrupt signal.

Therefore, when the earphone 200 is connected to the interface unit 140, the portable device 100 can alter the audio signal path provided to the interface unit 140 according to the type of the connected earphone. The type of earphone connected to the interface unit 140 may be detected by a first comparator, which will be described later, where the output of the first comparator is input to a control lead of a switch unit that alters the audio signal path. Because the audio signal path may be altered according to the type of earphone, the portable device can accommodate and properly support both a 5-pole earphone and a 4-pole earphone.

An exemplary configuration of the portable device 100 is described in detail as follows.

Figure 2:
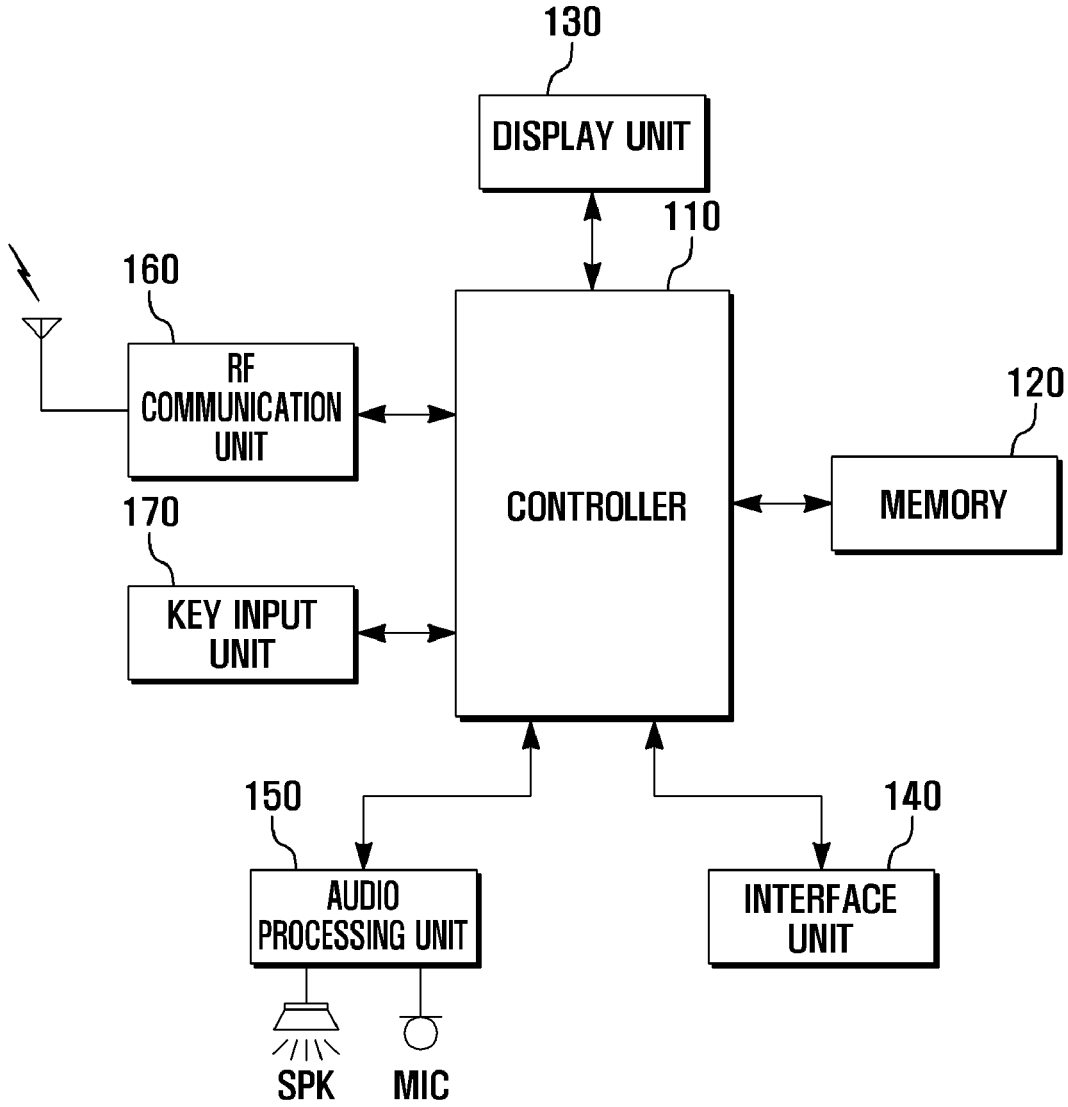
FIG. 2 is a schematic block diagram illustrating a portable device according to an exemplary embodiment of the present invention.

FIG. 2 is a schematic block diagram illustrating a portable device according to an exemplary embodiment of the present invention.

Referring to FIG. 2, the portable device 100 includes a Radio Frequency (RF) communication unit 160, a key input unit 170, an audio processing unit 150, an interface unit 140, a display unit 130, a memory 120, and a controller 110.

The RF communication unit 160 transmits and receives signals, related to a Short Message Service (SMS) or a Multimedia Message Service (MMS), a voice call, data communication, etc. to and from other portable devices. The RF communication unit 160 converts voice/audio data and control data into RF signals and transmits them. The RF communication unit 160 also receives RF signals from other portable devices, converts them into voice/audio data and control data, and outputs them as appropriate. To this end, the RF communication unit 160 may include an RF transmitter for up-converting the frequency of transmitted signals and amplifying the transmitted signals and an RF receiver for low-noise amplifying received RF signals and down-converting the frequency of the received RF signals.

The key input unit 170 may include numeric keys, letter keys, function keys, etc. for inputting numbers and letter information and for setting various functions. In particular, the key input unit 170 can input setting information related to function controls for the use of a PTT service. When the portable device is operated by the PTT key and accesses the PTT service, a portable device user can use one-to-one or one-to-multi service.

The audio processing unit 150 reproduces an audio signal received from the controller 110 through a speaker SPK or outputs audio signals, such as a voice received from a microphone MIC, to the controller 110. That is, the audio processing unit 150 converts voice/audio data into an audible sound and outputs it to the speaker SPK. It also converts audio signals, such as a voice, input through the microphone MIC into digital data and outputs them to the controller 110, so that the data can be transmitted to the other portable devices through the RF communication unit 160. The audio processing unit 150 may also output a particular audio sound indicating that the earphone 200 is connected or disconnected to or from the interface unit 140. The particular audio sound can be varied according to a user's input through a menu setting or a volume setting of the portable device.

The interface unit 140 provides a connection between the earphone 200 or other connected element and the portable device 100 and can be used to transmit audio signals to the earphone 200 and receive audio or other signals from other connected elements. The interface unit 140 provides an interface for signal transmission between the portable device 100 and the earphone 200. The interface unit 140 provides paths through which function sounds and effect sounds generated in the controller 110 can be transmitted to the earphone 200 or sounds received through the RF communication unit 160 are transmitted to the earphone 200.

The display unit 130 displays image data received from the controller 110, user data requested by a user, an additional function screen, etc. In an exemplary implementation, the display unit 130 is implemented by an LCD. In this case, the display unit 130 may include a controller for controlling the LCD, a video memory in which image data is stored and an LCD element. If the LCD is provided as a touch screen, the display unit 130 may perform a part or all of the functions of the key input unit 170. In another exemplary implementation, the display unit 130 may be implemented by an Organic Light Emitting Diode (OLED) or devices applied by the OLED. The display unit 130 can display screen data according to functions and operations of the earphone 200 and the function selection menu of the earphone 200. When the earphone 200 is connected to portable device 100 through the interface unit 140, the display unit 130 can display a guide message corresponding to the connection according to the control of the controller 110. More specifically, when the earphone 200 is connected to the interface unit 140, the display unit 130 may generate a pop-up window indicating the connection of the earphone 200 or display an icon at one side of the screen, notifying the user that the earphone 200 is connected and in use. When a user presses the call key 210 of the earphone 200, the display unit 130 may display a call list stored in the memory 120 according to the control of the controller 110. It will be easily appreciated by those skilled in the art that the method for displaying the connection state and service providing state of the portable device 100 can be modified in various ways according to the purpose of the portable devices or the selection of the user.

The memory 120 stores an Operating System (OS) for booting the portable device and application programs for performing a variety of functions, such as a file reproduction function, a camera function, a broadcasting view function, etc. The memory 120 also stores data generated as the portable device 100 executes its functions, data received through communication channels, etc. In an exemplary implementation, the memory 120 includes a program memory and a data memory.

The program memory stores application programs for supporting the functions described above. When a function is activated according to a user's request, the controller 110 executes a corresponding application program and provides the function to the user.

The data memory stores data generated while the application programs are executed. For example, when the call key 210 is pressed, the data memory may store a call list that is then displayed on the display unit 130. The data is stored in a database form in the data memory.

The controller 110 controls operations of the portable device and controls signal flows between blocks in the portable device. For example, the controller 110 controls signals between the RF communication unit 160, the key input unit 170, the memory 120, the interface unit 140, the audio processing unit 150, the display unit 130, the earphone 200, etc. In particular, the controller 110 can detect the connection of the earphone 200 through a General Purpose Input/Output (GPIO) port. The controller 110 also can detect the activation of the call key 210 through the GPIO port. While the portable device 100 according to an exemplary embodiment of the present invention has been schematically illustrated in FIG. 2, it should be understood that the present invention is not so limited. It will be easily appreciated by those skilled in the art that the portable device 100 can be modified in various ways, according to its purpose. For example, it may further include a camera, a digital broadcasting part, and other components equivalent thereto.

In the following description, circuits of first and second comparators 300 and 310 and a switch part 400 are explained in more detail with reference to FIG. 3 and FIG. 4. The first comparator 300 serves to detect the type of earphone 200 connected to the interface unit 140. The second comparator 310 serves to detect execution of the PTT key 210. The switch part 400 serves to alter the path of an audio signal according to the detected type of earphone.

Figure 3:
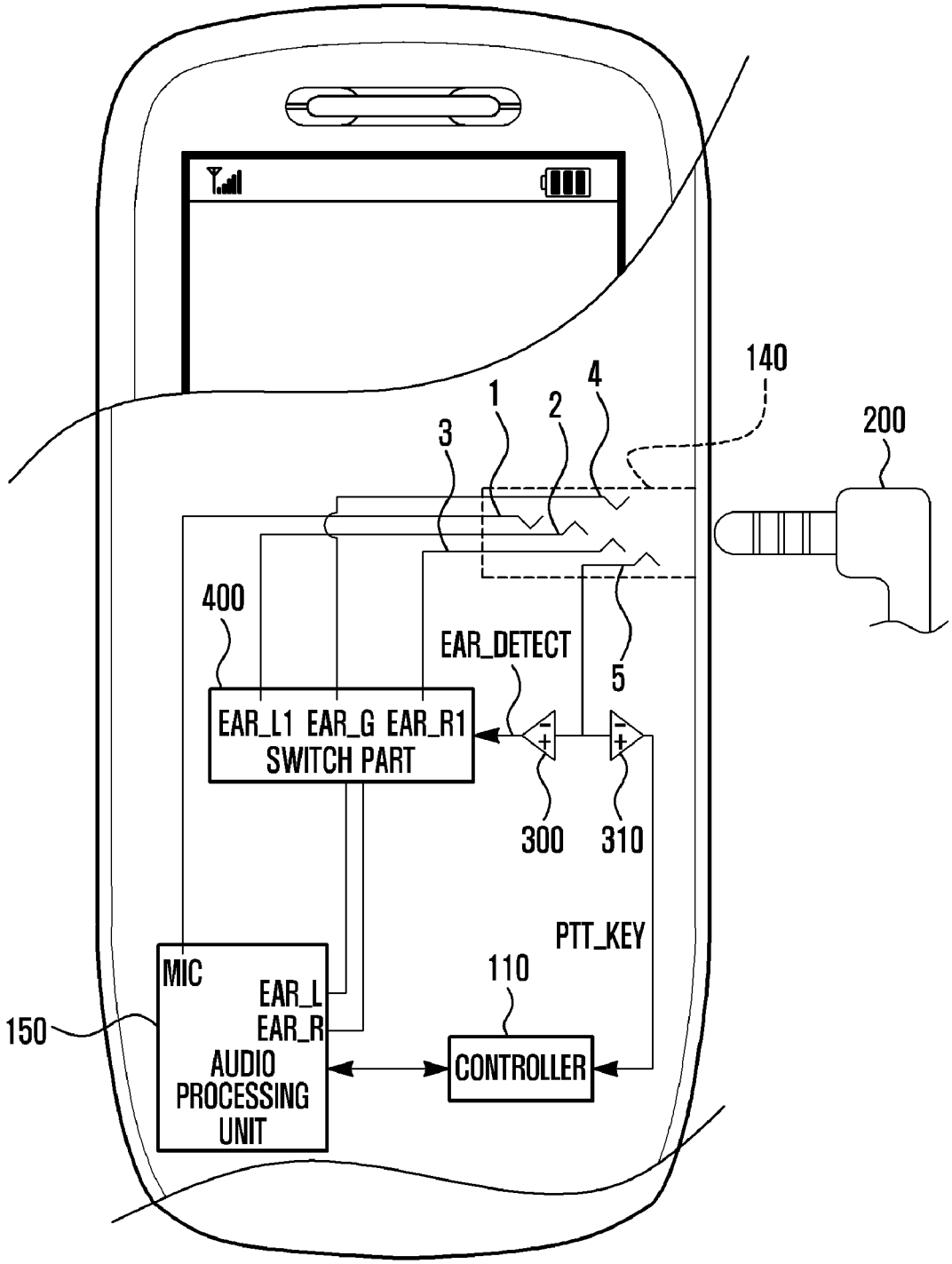
FIG. 3 is a schematic block diagram illustrating a compatible circuit for a 4-pole earphone and a 5-pole earphone, according to an exemplary embodiment of the present invention.

FIG. 3 is a schematic block diagram illustrating a compatible circuit for a 4-pole earphone and a 5-pole earphone, according to an exemplary embodiment of the present invention. The compatible circuit includes an earphone 200, an interface unit 140, first and second comparators 300 and 310, an audio processing unit 150, a switch part 400, and a controller 110.

Referring to FIG. 3, the earphone 200 is connected to the interface unit 140. The first comparator 300 determines whether the connected earphone 200 is a 4- or 5-pole earphone and outputs a control signal EAR_DETECT to the control lead of the switch part 400. The switch part 400 alters the path of an audio signal from the audio processing unit 150 according to the control signal EAR_DETECT. The second comparator 310 detects whether the call key (not shown) is operated and outputs the detected result to the controller 110. The second comparator 310 outputs an output signal PTT_KEY of a high level when the call key 210 is not operated and a low level when the call key is operated.

Figure 4:
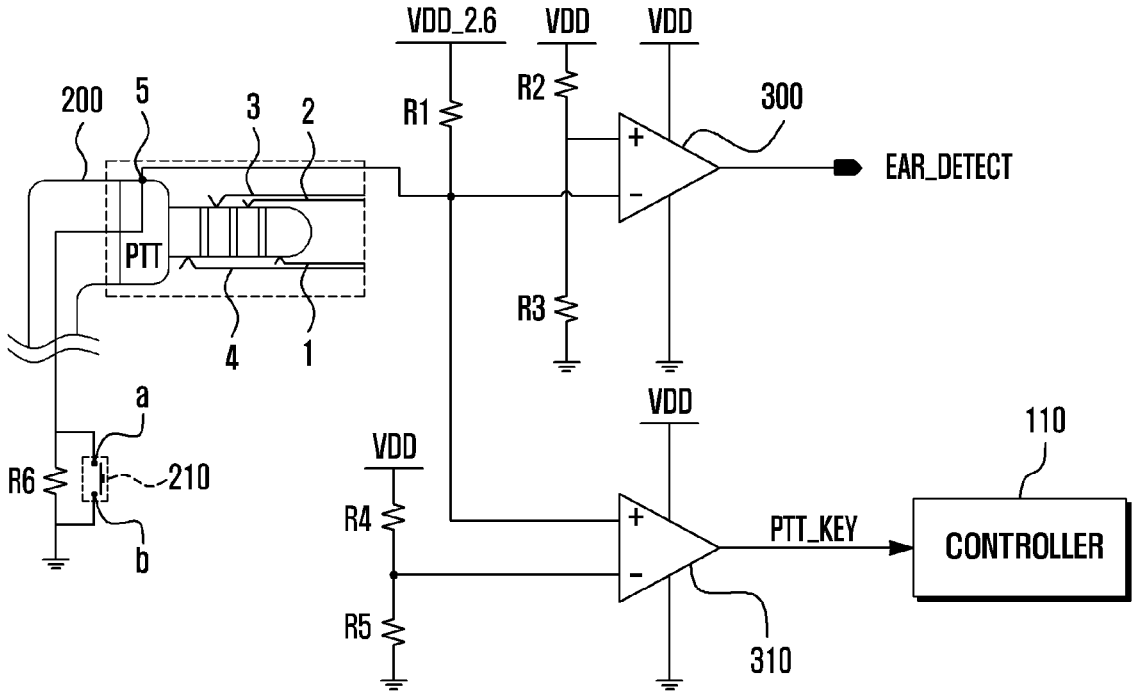
FIG. 4 is a detailed view illustrating a compatible circuit for a 4-pole earphone and a 5-pole earphone, according to an exemplary embodiment of the present invention.

FIG. 4 is a detailed view illustrating a compatible circuit for detecting a type of earphone according to an exemplary embodiment of the present invention.

Before explaining an exemplary method for detecting a type of earphone, the operation of the first and second comparators 300 and 310 is briefly described. Each of the comparators 300 and 310 is supplied power from a power source VDD. Each of the comparators 300 and 310 compares the input voltage of the inverting input terminal (−) with the input voltage of the non-inverting input terminal (+). When the input voltage of the non-inverting input terminal (+) is higher than that of the inverting input terminal (−), a High signal is output. On the contrary, when the input voltage of the inverting input terminal (−) is higher than that of the non-inverting input terminal (+), a Low signal is output.

Referring to FIG. 4, when a 4-pole earphone is connected to the interface unit 140, the first comparator 300 does not receive a signal from terminal No. 5 of the interface unit 140 since the 4-pole earphone has only four contacts and thus terminal No. 5 of the interface unit 140 is not connected to any contact of the 4-pole earphone. That is, the 4-pole earphone has a "Not Connect (NC)." Therefore, the first comparator 300 outputs an output signal at a low level. More specifically, the first comparator 300 receives power of a source VDD_2.6 at the inverting input terminal (−) via a resistor R1. Here, the inverting input terminal (−) receives a voltage of 2.6V. The voltage of a power source VDD is divided by resistors R2 and R3 and the divided voltage is supplied to the non-inverting input terminal (+) of the first comparator 300. The divided voltage is the reference voltage of the first comparator 300 and needs to be set lower than the input voltage of the inverting input terminal (−). That is, since the inverting input terminal (−) receives 2.6V, it is preferable that resistors R2 and R3 be selected so that the non-inverting input terminal (+) can receive a voltage of less than 2.6V. Here, the reference voltage is determined by the ratio of resistances of R2 and R3. Since the principle of the voltage divider is well known to those skilled in the art, it is not described in the application. Therefore, when a 4-pole earphone is connected to the interface unit 140 of the portable device, the voltage of the inverting input terminal (−) is higher than that of the non-inverting input terminal (+) and thus the first comparator 300 outputs a low value for the signal EAR_DETECT.

On the contrary, when a 5-pole earphone is connected to the portable device, the first comparator 300 outputs a high value for the signal EAR_DETECT. Contact No. 5 of the 5-pole earphone is connected to terminal No. 5 of the interface unit 140. Therefore, the voltage of a source VDD_2.6 is divided by resistors R1 and R6 and then the divided voltage is supplied to the inverting input terminal (−) of the first comparator. Here, the divided voltage is required to be less than the reference voltage input to the non-inverting input terminal (+). Therefore, when a 5-pole earphone is connected to the interface unit 140 of the portable device, the voltage of the non-inverting input terminal (+) of the first comparator 300 is higher than that of the inverting input terminal (−) and thus the first comparator 300 outputs a high value for the signal EAR_DETECT.

As described above, the compatible circuit can detect the type of earphone connected to the interface unit 140 of the portable device based on the operation in which the first comparator 300 outputs different output levels according to the type of earphone. Here, the output terminal (providing the signal EAR_DETECT) of the first comparator 300 is connected to the control lead of the switch part 400 and the output signal EAR_DETECT serves as a control signal that alters the path of an audio signal according to the type of earphone.

In the following description, the operation of the second comparator 310 is explained in detail with reference to FIG. 4, wherein the second comparator 310 detects the operation of the PTT key 210 of a 5-pole earphone.

When a 5-pole earphone is connected to the interface unit 140, the voltage of a source VDD_2.6 is divided by resistors R1 and R6 and the divided voltage is supplied to the non-inverting input terminal (+) of the second comparator 310. Here, the divided voltage is the same as that supplied to the inverting input terminal (−) of the first comparator 300. The voltage of the power source VDD is divided by resistors R4 and R5 and the divided voltage as the reference voltage is input to the inverting input terminal (−) of the second comparator 310. It is preferable that the divided input voltage input to the inverting input terminal (−) is less than the voltage input to the non-inverting input terminal (+). Therefore, the second comparator outputs a high value for the signal PTT_KEY.

When the call key 210 is operated, the ground level voltage is input to the non-inverting input terminal (+) of the second comparator 310. That is, when the call key 210 is pressed, points a and b are connected to each other and thus the non-inverting terminal (+) of the second comparator 310 is grounded. That is, the input voltage of the non-inverting input terminal (+) is a ground level voltage. Therefore, the input voltage of the inverting input terminal (−) is higher than that of the non-inverting input terminal (+), and thus the second comparator 310 outputs a low value for the signal PTT_KEY.

The output signal PTT_KEY of the second comparator 310 is input to the GPIO terminal of the controller 110. The controller 110 receives a signal through the GPIO terminal and detects the operation states of the call key 210 in order to perform a corresponding function. For example, when the call key is pressed, the controller 110 may control the display unit 130 to display a call list or perform a control so that the last phone number can be automatically dialed. When a user also uses a PTT service, the controller 110 may control the portable device to switch from a reception mode to a transmission mode.

Based on the description referring to FIG. 3 and FIG. 4, a range of voltage input to respective comparators is explained with reference to Table 1.

TABLE 1

| | 4-pole earphone in connection | | 5-pole earphone in connection (Call key, not operated) | | 5-pole earphone in connection (Call key, operated) | |
|---|---|---|---|---|---|---|
| | 1st Com. | 2nd Com. | 1st Com. | 2nd Com. | 1st Com. | 2nd Com. |
| Non-inv. input terminal (+) | Va | 2.6 V | Va | Vc (Vb < Vc < Va) | Va | Vc (Vc = 0) |
| Inv. input terminal (−) | 2.6 V | Vb (Vb > 0) | Vc (Vb < Vc < Va) | Vb | Vc (Vc = 0) | Vb (Vb > 0) |
| Output | Low | High | High | High | High | Low |

As described in Table 1, Va denotes the reference voltage generated as the VDD voltage is divided by resistors R2 and R3 and is input to the non-inverting input terminal (+) of the first comparator 300. Vb denotes the reference voltage created as the VDD voltage is divided by resistors R4 and R5 and is input to the inverting input terminal (−) of the second comparator 310. The reference voltage Va or Vb is a constant value regardless of whether a 4- or 5-pole earphone is connected to the portable device. Vc denotes a comparative voltage that is input to the inverting input terminal (−) of the first comparator 300 and the non-inverting input terminal (+) of the second comparator 310 when a 5-pole earphone is connected to the portable device.

Referring to Table 1, when a 4-pole earphone is connected, the output level of the first comparator 300 is low and, to this end, a condition, Va<2.6V, must be satisfied. When a 5-pole earphone is connected, the output level of the first comparator 300 is high and, to this end, a condition, Va<Vc, must be satisfied. If a call key is not operated when a 5-pole earphone is connected, the output level of the second comparator 310 is high and, to this end, a condition Vb>Vc must be satisfied. When a call key is used, the output level of the second comparator is low and, to this end, a condition Vb>0 (=Vc) must be satisfied. Therefore, when the call key is not operated, the entire condition is 2.6>Va>Vc (call key, not operated)>Vb>0. On the contrary, when the call key is operated, the condition is 2.6>Va>Vb>Vc=0 (call key, operated).

Based on the range of voltage described above, the portable device engineer can determine the voltage values input to the inverting input terminal (−) and the non-inverting input terminal (+) of the first comparator 300 or second comparator 310, the ratio of resistances, and the resistances.

The range of voltage described in Table 1 is merely an example of the present invention, and it should be understood that the present invention is not limited by these values.

In the following description, the path of an audio signal is explained, when a 4- or 5-pole earphone is connected to the interface unit 140, with reference to FIG. 5 and FIG. 6.

Figure 5:
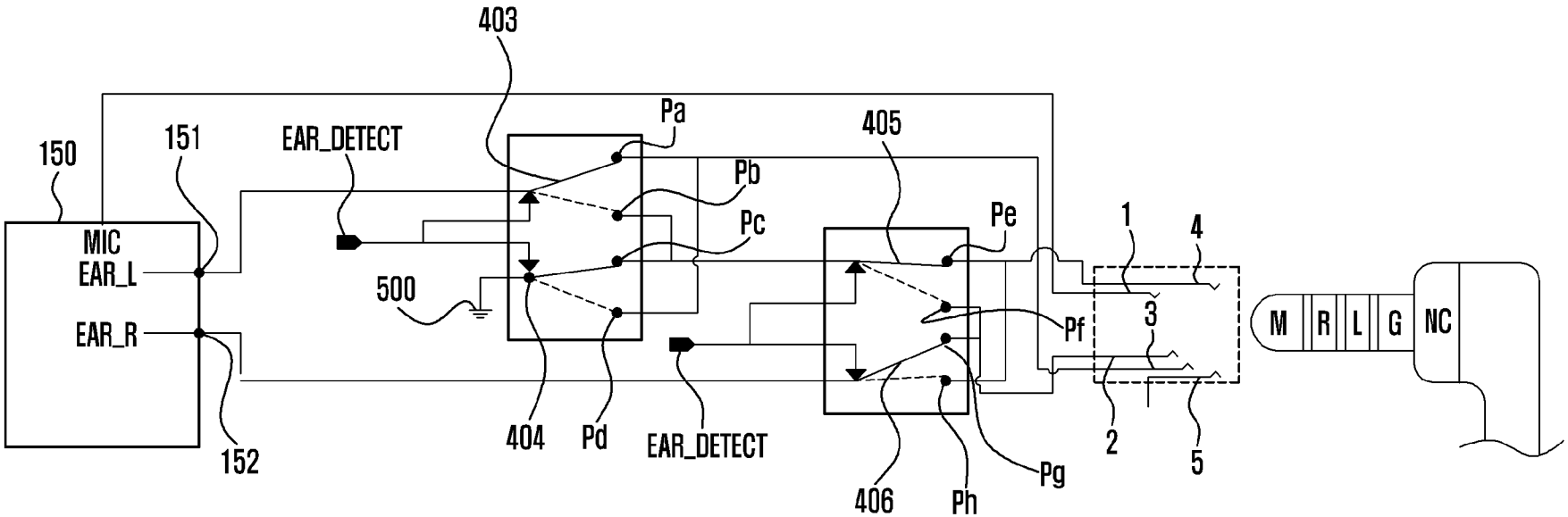
FIG. 5 is a circuit describing an audio signal path when a 4-pole earphone is connected to the portable device, according to an exemplary embodiment of the present invention.

FIG. 5 is a circuit describing an audio signal path from the audio processing unit 150 to the earphone 200 when a 4-pole earphone is connected to the portable device, according to an exemplary embodiment of the present invention. The path of the microphone terminal is fixed regardless of the type of earphone and thus its description is omitted herein.

Referring to FIG. 5, the circuit requires four switches to alter the path of an audio signal according to the type of earphone. In an exemplary embodiment of the present invention, the circuit is configured to include two switch modules each of which has two switches However, it should be understood that the present invention is not limited by this example. That is, the circuit may be modified for example, to include four switches or a module that has a plurality of switches.

According to the type of earphone connected, the audio signal path is altered by the first switch 403, second switch 404, third switch 405 and fourth switch 406 that are controlled by the output signal EAR_DETECT of the first comparator 300.

The following description illustrates the path of an audio signal when a 4-pole earphone is connected to the interface unit 140.

As illustrated in FIG. 5, when a 4-pole earphone is connected to the interface unit 140, the value of the signal EAR_DETECT output from the first comparator 300 is at a low level signal. The value of the signal EAR_DETECT is input to the control leads of the first to fourth switches 403~406. By input of the low level signal to the switches 403~406, the first switch 403 is switched to point Pa, the second switch 404 is switched to point Pc, the third switch 405 is switched to point Pe, and the fourth switch 406 is switched to point Pg, respectively. Based on these switch positions, the audio signal paths are altered as follows.

Regarding the Path of a Left Audio Signal EAR_L Output from the Audio Processing Unit 150:

The left audio signal terminal 151 of the audio processing unit 150 is connected to the first switch 403. The first switch 403 is switched to point Pa according to the control signal EAR_DETECT of the first comparator 300. Therefore, the path of the left audio signal EAR_L passes to terminal No. 3 of the interface unit 140 through point Pa so that the left audio signal is provided to contact No. 3 of the 4-pole earphone when the 4-pole earphone is connected to the interface unit 140.

Regarding the Path of a Right Audio Signal EAR R:

The path of the right audio signal EAR_R is from the right audio signal terminal 152 of the audio processing unit 150 to the fourth switch 406. Here, the fourth switch 406 is switched to point Pg according to the control signal EAR_DETECT of the first comparator 300. Therefore, the path of the right audio signal EAR_R passes to terminal No. 2 of the interface unit 140 so that the right audio signal is provided to contact No. 2 of the 4-pole earphone when the 4-pole earphone is connected to the interface unit 140.

Regarding the Path of a Ground Signal G:

The second switch 404 is connected to the ground 500 and switched to point Pc according to the control signal EAR_DETECT of the first comparator 300. The path of a ground signal G passes through point Pc to the third switch 405. The third switch 405 is switched to point Pe according to the control signal EAR_DETECT of the first comparator 300. The path of a ground signal G passes through point Pe to terminal No. 4 of the interface unit 140 so that contact No. 4 of the 4-pole earphone is grounded when the 4-pole earphone is connected to the interface unit 140.

Accordingly, when the 4-pole earphone is connected to the interface unit 140, the proper audio signals are input to contacts of the 4-pole earphone. More specifically, a microphone signal MIC is input to terminal No. 1, a right audio signal EAR_R to terminal No. 2, a left audio signal EAR_L to terminal No. 3, and a ground signal G to terminal No. 4. As also illustrated in FIG. 5, this configuration corresponds to the pin map of the 4-pole earphone. That is, the microphone signal input to terminal No. 1 is connected to the "M" pin of the 4-pole earphone. Similarly, the EAR_R signal input to terminal No. 2 is provided to the "R" pin, the EAR_L signal is provided to the "L" pin and the G signal is provided to the "G" pin. Therefore, the circuit allows a 4-pole earphone to be used in a portable device that has been designed to use a 5-pole earphone.

Referring again to FIG. 4, terminal No. 5 of the interface unit 140 is connected to the input terminals of the first and second comparators 300 and 310. However, as illustrated in FIG. 5, contact No. 5 of the 4-pole earphone is in a Not Connect (NC) state, so that the 4-pole earphone is not connected to terminal No. 5 of the interface unit 140.

In the following description, the path of an audio signal is explained, when a 5-pole earphone is connected to the interface unit 140, with reference to FIG. 6.

Figure 6:
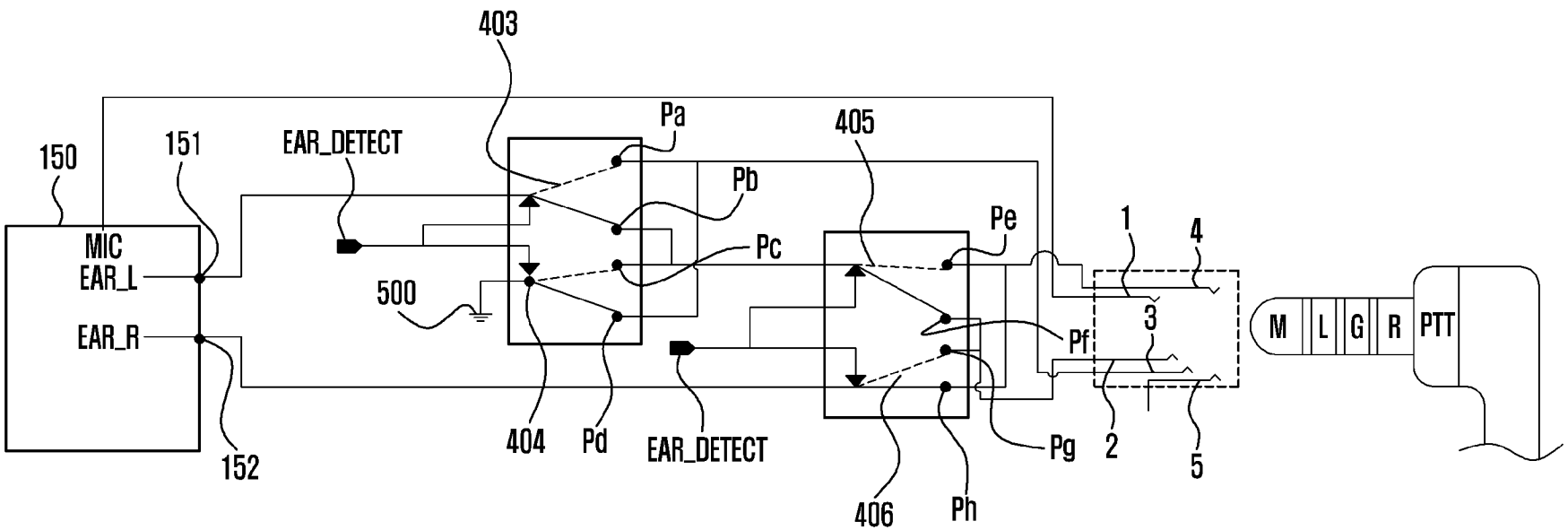
FIG. 6 is a circuit describing an audio signal path when a 5-pole earphone is connected to the portable device, according to an exemplary embodiment of the present invention.

FIG. 6 is a circuit describing an audio signal path when a 5-pole earphone is connected to the portable device, according to an exemplary embodiment of the present invention.

Referring to FIG. 6, when a 5-pole earphone is connected to the interface unit 140, the value of the signal EAR_DETECT output from the first comparator 300 is at a high level. The value of the signal EAR_DETECT is input to the control leads of the first to fourth switches 403~406 and controls the switches 403~406 so that the first switch 403 is switched to point Pb, the second switch 404 is switched to point Pd, the third switch 405 is switched to point Pf, and the fourth switch 406 is switched to point Ph, respectively. Based on these switch positions, the audio signal paths are altered as follows.

Regarding the Path of a Left Audio Signal EAR L Output from the Audio Processing Unit 150:

The left audio signal terminal 151 of the audio processing unit 150 is connected to the first switch 403. The first switch 403 is switched to point Pb according to the control signal EAR_DETECT of the first comparator 300. Accordingly, the path of the left audio signal EAR_L is connected to the third switch 405 after passing through point Pb. The third switch 405 is switched to point Pf according to the control signal EAR_DETECT. Therefore, the path of the left audio signal is connected to terminal No. 2 of the interface unit 140 after passing through point Pf, so that the left audio signal is provided to contact No. 2 of the 5-pole earphone when the 5-pole earphone is connected to the interface unit 140.

Regarding the Path of a Right Audio Signal EAR_R:

The path of the right audio signal EAR_R is from the right audio signal terminal 152 of the audio processing unit 150 to the fourth switch 406. Here, the fourth switch 406 is switched to point Ph according to the control signal EAR_DETECT of the first comparator 300. Accordingly, the path of the right audio signal EAR_R is connected to terminal No. 4 of the interface unit 140 passing through point Ph, so that the right audio signal is provided to contact No. 4 of the 5-pole earphone when the 5-pole earphone is connected to the interface unit 140.

Regarding the Path of a Ground Signal G:

The second switch 404 is connected to the ground 500 and switched to point Pd according to the control signal EAR_DETECT of the first comparator 300. Accordingly, the path of a ground signal G is connected to terminal No. 3 of the interface unit 140 passing through point Pd, so that contact No. 3 of the 5-pole earphone is grounded when the 5-pole earphone is connected to the interface unit 140.

Accordingly, when the 5-pole earphone is connected to the interface unit 140, the proper audio signals are input to the contacts of the 5-pole earphone. More specifically, a microphone signal MIC is input to terminal No. 1, a left audio signal EAR_L to terminal No. 2, a ground signal G to terminal No. 3, and a right audio signal EAR_R to terminal No. 4. As also illustrated in FIG. 6, this configuration corresponds to the pin map of the 5-pole earphone. That is, the microphone signal input to terminal No. 1 is connected to the "M" pin of the 4-pole earphone. Similarly, the EAR_R signal input to terminal No. 4 is provided to the "R" pin, the EAR_L signal is provided to the "L" pin and the G signal is provided to the "G" pin.

As described above referring to FIG. 4, terminal No. 5 of the interface unit 140 is connected to contact No. 5 of the 5-pole earphone and also to the input terminals of the first and second comparators 300 and 310. Because the operation has been already explained above with the description referring to FIG. 3 and FIG. 4, it will not be explained again for conciseness.

As described above, although exemplary embodiments of the present invention are implemented in such a way that the output of the first comparator is low when a 4-pole earphone is connected to the portable device and high when a 5-pole earphone is connected, it will be easily appreciated that the invention can be modified in such a way that the output of the first comparator is high when a 4-pole earphone is connected to the portable device and low when a 5-pole earphone is connected.

Although exemplary embodiments of the present invention are implemented in such a way that the output of the second comparator is high when a call key is not operated and low when the call key is operated, it will be easily appreciated that the invention can also be implemented by effecting opposite values than those described herein.

As further described above, the compatible circuit and method, according to exemplary embodiments of the present invention, can allow 4- and 5-pole earphones to be used in a portable device being primarily designed for a 5-pole earphone, thereby providing greater convenience for users of the portable device.

Although exemplary embodiments of the present invention have been described in detail hereinabove, it should be understood that many variations and modifications of the basic inventive concept herein described, which may be apparent to those skilled in the art, will still fall within the spirit and scope of the exemplary embodiments of the present invention as defined in the appended claims and their equivalents.

What is claimed is:

1. A compatible circuit for 4-pole and 5-pole earphones, the circuit comprising:

an interface unit to which one of a 4-pole earphone and a 5-pole earphone is connected;

a first comparator for detecting if the one of the 4-pole earphone and the 5-pole earphone is connected to the interface unit and for outputting a signal based on the detection result; and a switch part for establishing a path of at least one audio signal according to the output signal of the first comparator.

2. The circuit of claim 1, wherein the first comparator outputs a first signal when the 4-pole earphone is connected and outputs a second signal, different from the first signal, when the 5-pole earphone is connected.

3. The circuit of claim 2, wherein the first signal comprises a low level signal and the second signal comprises a high level signal.

4. The circuit of claim 1, further comprising:

a second comparator for detecting an operation of a call key of the 5-pole earphone and for outputting a signal based on the detection result; and a controller for determining whether the call key is operated according to the output signal of the second comparator.

5. The circuit of claim 4, wherein the second comparator outputs a third signal when the call key is not operated and outputs a fourth signal, different from the third signal, when the call key is operated.

6. The circuit of claim 5, wherein the third signal comprises a high level signal and the fourth signal comprises a low level signal.

7. A method for using 4-pole and 5-pole earphones, the method comprising:

detecting, by a first comparator, whether one of a 4-pole earphone and a 5-pole earphone is connected to an interface unit of a portable device; and establishing a path of at least one audio signal according to the detected type of earphone.

8. The method of claim 7, further comprising:

determining whether a call key is operated.

9. The method of claim 7, wherein the detecting of whether the one of the 4-pole and the 5-pole earphone is connected to an interface unit comprises:

outputting a first signal from a first comparator when the 4-pole earphone is connected to the interface unit; and outputting a second signal from the first comparator when the 5-pole earphone is connected to the interface unit, wherein the second signal is different from the first signal.

10. The method of claim 9, wherein the first signal comprises a low level signal and the second signal comprises a high level signal.

11. The method of claim 8, wherein the determining of whether the call key is operated comprises:

outputting a third signal from a second comparator when the call key is not operated; and outputting a fourth signal from the second comparator when the call key is operated, wherein the fourth signal is different from the third signal.

12. The method of claim 11, wherein the third signal comprises a high level signal and the fourth signal comprises a low level signal.

13. The method of claim 7, wherein the establishing of the path of the at least one audio signal comprises:

outputting a left audio signal; and outputting a right audio signal.

14. The method of claim 13, wherein, when the 4-pole earphone is connected to the interface unit, the establishing of the path of the at least one audio signal comprises:

establishing a first path including a source of a left audio signal, a first switch connected to the source of the left audio signal, a third terminal of the interface unit connected to the first switch, and a third contact of the 4-pole earphone connected to the third terminal of the interface unit;

establishing a second path including a ground connection, a second switch connected to the ground connection, a third switch connected to the second switch, a fourth terminal of the interface unit connected to the third switch, and a fourth contact of the 4-pole earphone connected to the fourth terminal of the interface unit; and establishing a third path including a source of a right audio signal, a fourth switch connected to the source of the right audio, a second terminal of the interface unit connected to the fourth switch, and a second contact of the 4-pole earphone connected to the second terminal of the interface unit.

15. The method of claim 13, wherein, when the 5-pole earphone is connected to the interface unit, the establishing of the path of the at least one audio signal comprises:

establishing a fourth path including a source of a left audio signal, a first switch connected to the source of the left audio signal, a third switch connected to the first switch, a second terminal of the interface unit connected to the third switch, and a second contact of the 5-pole earphone connected to the second terminal of the interface unit;

establishing a fifth path including a ground connection, a second switch connected to the ground connection, a third terminal of the interface unit connected to the second switch, and a third contact of the 5-pole earphone connected to the third terminal of the interface unit; and establishing a sixth path including a source of a right audio signal, a fourth switch connected to the source of the right audio signal, a fourth terminal of the interface unit connected to the fourth switch, and a fourth contact of the 5-pole earphone connected to the fourth terminal of the interface unit.

16. A portable device comprising:

an interface unit to which one of a 4-pole earphone and a 5-pole earphone is connected;

a first comparator for detecting if the one of the 4-pole earphone and the 5-pole earphone is connected to the interface unit and for outputting a signal based on the detection result;

a switch part for establishing a path of at least one audio signal according to the output signal of the first comparator;

an audio processing unit for outputting an audio signal to the one of the 4-pole and the 5-pole earphone through the switch part and the interface unit; and a controller for controlling the audio processing unit to generate the audio signal.

17. The portable device of claim 16, wherein the first comparator outputs a first signal when the 4-pole earphone is connected to the interface unit and outputs a second signal, different from the first signal, when the 5-pole earphone is connected to the interface unit.

18. The portable device of claim 17, wherein the first signal comprises a low level signal and the second signal comprises a high level signal.

19. The portable device of claim 16, further comprising a second comparator for detecting an operation of a call key of the 5-pole earphone and for outputting a signal based on the detection result, wherein the controller determines whether the call key is operated according to the output signal of the second comparator.

20. The portable device of claim 19, wherein the second comparator outputs a third signal when the call key is not operated and a fourth signal, different from the third signal, when the call key is operated.

21. The portable device of claim 20, wherein the third signal comprises a high level signal and the fourth signal comprises a low level signal.

* * * * *